United States Patent [19]

Emmrich et al.

[11] Patent Number: 5,031,754

[45] Date of Patent: Jul. 16, 1991

[54] METHOD OF WORKING UP AN OVERHEAD PRODUCT OF AN EXTRACTIVE DISTILLATION OF A HYDROCARBON MIXTURE AND APPARATUS FOR SAME

[75] Inventors: Gerd Emmrich, Essen; Hans-Christoph Schneider, Hattingen; Ulrich Rüdel, Oberhausen, all of Fed. Rep. of Germany

[73] Assignee: Krupp Koppers GmbH, Essen, Fed. Rep. of Germany

[21] Appl. No.: 467,876

[22] Filed: Jan. 19, 1990

[30] Foreign Application Priority Data

Jan. 20, 1989 [DE] Fed. Rep. of Germany ..... 3901587

[51] Int. Cl.[5] ..... B01D 3/40

[52] U.S. Cl. ..... 203/58; 202/176; 202/204; 203/75; 203/78; 203/80; 203/82; 203/84; 203/DIG. 25; 208/349; 208/355; 208/364; 210/521; 210/522; 210/802; 210/DIG. 5

[58] Field of Search ..... 203/58, 80, 82, 78, 203/75, 84, DIG. 25; 202/176, 204; 159/901, DIG. 23; 208/349, 355, 364; 210/DIG. 5, 522, 521, 802

[56] References Cited

U.S. PATENT DOCUMENTS

| | | | |
|---|---|---|---|
| 2,376,870 | 5/1945 | Engel | 203/51 |
| 3,844,902 | 10/1974 | Vickers et al. | 203/58 |
| 4,032,332 | 6/1977 | Gerlach | 423/23 |
| 4,056,371 | 11/1977 | Diemer et al. | 55/90 |
| 4,081,355 | 3/1978 | Preusser et al. | 203/58 |
| 4,191,615 | 3/1980 | Schulze et al. | 203/58 |
| 4,299,667 | 11/1981 | Klein et al. | 203/58 |
| 4,498,980 | 2/1985 | Forte | 208/321 |
| 4,664,754 | 5/1987 | Caputi et al. | 202/204 |
| 4,781,820 | 11/1988 | Forte | 208/321 |
| 4,877,594 | 10/1989 | Bierman et al. | 423/321 S |
| 4,897,206 | 1/1990 | Castelli | 210/DIG. 5 |

FOREIGN PATENT DOCUMENTS

| | | | |
|---|---|---|---|
| 0512198 | 4/1955 | Canada | 203/58 |

OTHER PUBLICATIONS

Caulson et al., "Chemical Engineering", vol. Two, Third Edition, p. 600.

*Primary Examiner*—Virginia Manoharan
*Attorney, Agent, or Firm*—Michael J. Striker

[57] ABSTRACT

A hydrocarbon material of the starting product is separated in an extractive distillation column in which an N-substituted morpholine whose substituents do not have more than seven carbon atoms is used as a selective solvent. The overhead product comes down as a top product of the extractive distillation and is fed through a coalescer in which the sump product comes down with a solvent content of 20 to 75% by weight at a temperature of 20° to 70° C. and subsequent to that is fed into a separating vessel. There it is separated into a heavier and lighter phase. After that the heavier phase is conducted into an extractive distillation column and the lighter phase into the overhead product distillation column.

4 Claims, 2 Drawing Sheets

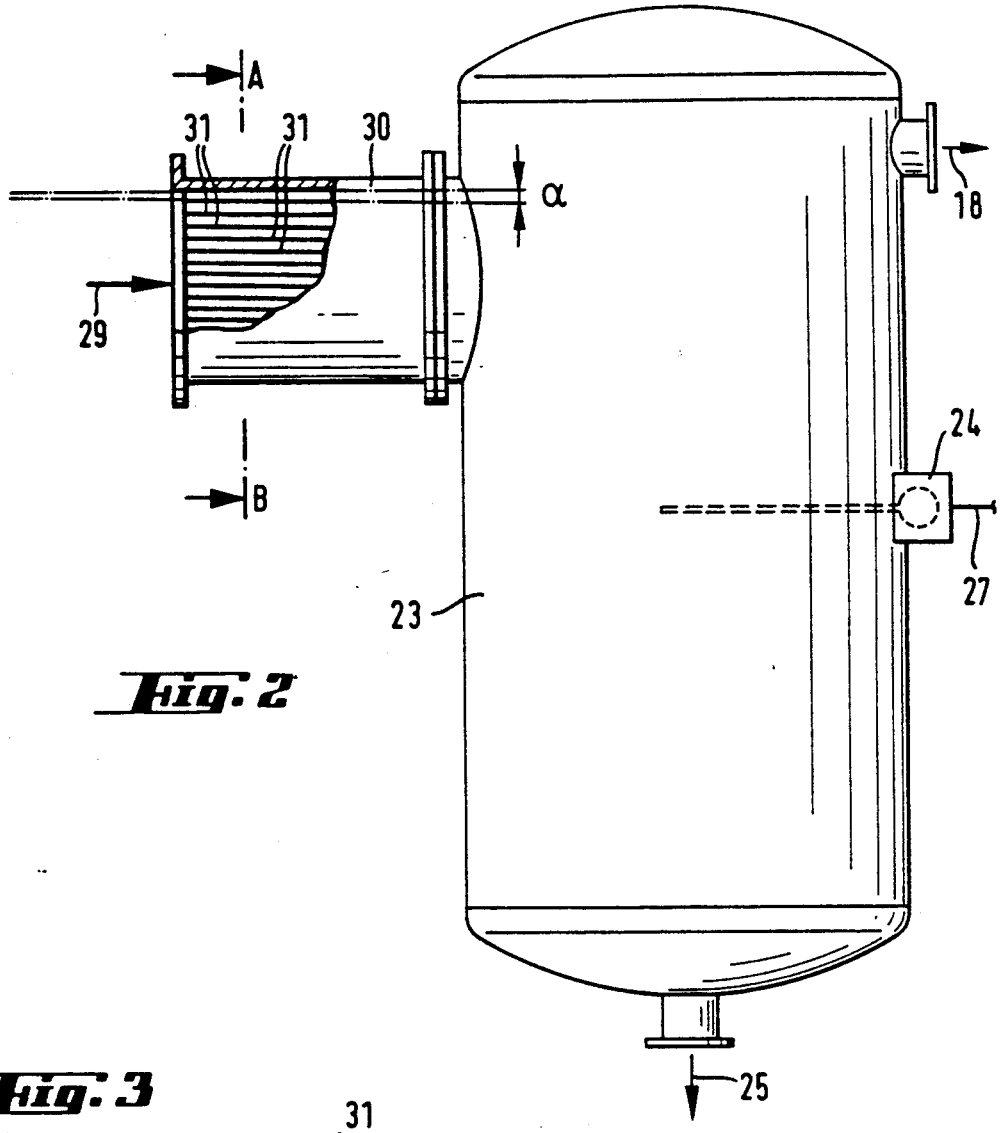
Fig. 2
Fig. 3
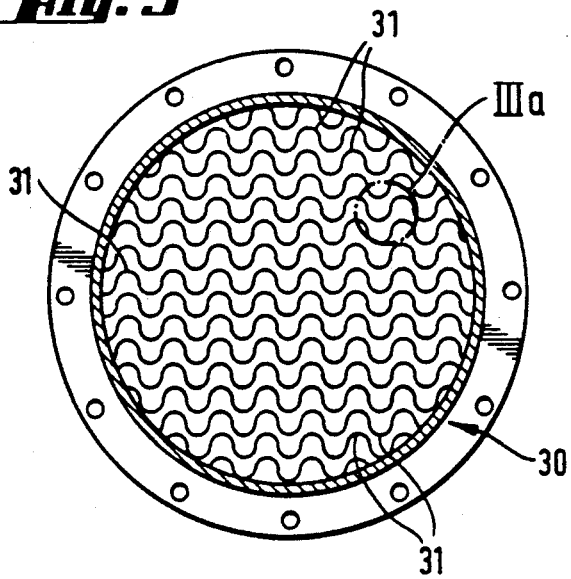
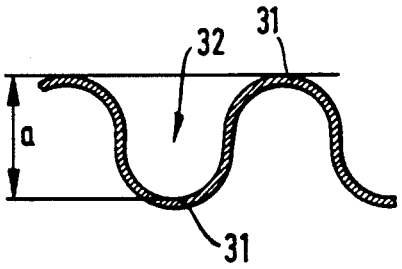
Fig. 3a

METHOD OF WORKING UP AN OVERHEAD PRODUCT OF AN EXTRACTIVE DISTILLATION OF A HYDROCARBON MIXTURE AND APPARATUS FOR SAME

BACKGROUND OF THE INVENTION

The present invention relates to a method or process of working up an overhead product of an extractive distillation of a hydrocarbon mixture. It also relates to an apparatus for performing that process.

A method or process of working up an overhead product of an extractive distillation of a hydrocarbon mixture is known, in which N-substituted morpholines, whose substituents do not have more than seven carbon atoms are used as selective solvents. The lower boiling components of the hydrocarbon mixture serving as starting product are drawn off as an overhead product from the head of the extractive distillation column. After that the overhead product is distilled for recovery of the residual solvent present in it and the sump product coming down with a certain amount of solvent is taken from the overhead product distillation column and is separated into a light phase and a heavy phase. The heavy phase is subsequently fed back into the extractive distillation column and the light phase is fed back to the overhead product distillation column.

The above-described extractive distillation process has been known for several years and used for separating hydrocarbon mixtures of differing compositions, for example for separation of aromates and nonaromates or for separation of olefins and/or diolefins and paraffins. In large scale industrial processing this process has proven especially useful for producing high-purity aromates using N-formyl morpholine as a selective solvent. In performing this process the sump product drawn from the extractive distillation column is normally fed to a subsequent decanter column, in which the hydrocarbons contained in it are separated as a distillative extract from the solvent. The solvent is then drawn off from the sump of the decanter column and returned to the extractive distillation column. The feed and/or return of the solvent occurs normally to the head of the extractive distillation column. Because of that the production of an overhead product with a certain amount of solvent can not be avoided in practice, the solvent content in the overhead product amounting to about 2% by weight. Because of economic reasons and because as pure as possible an overhead product must be obtained it is absolutely necessary to recover this solvent component again from the overhead product.

This would certainly be possible, if one drives the extractive distillation column with a suitably high overhead product reflux. In contrast to the normal distillation however in the extractive distillation a reflux of this type is inapplicable and thus must be avoided because:

1. An overhead product reflux leads to a dilution of the solvent and thus to a selective reduction, whereby the desired material separation is made unnecessarily difficult.

2. Highly selective solvent — and here the above-named N-substituted Morpholines — have only a limited dissolving power for the low boiling hydrocarbon component. The overhead product reflux can thus lead to the formation of two fluid phases with different densities in the upper plates of the extraction column, which makes impossible a problem-free operation of the extractive distillation column.

This possibility for recovery of the solvent component from the overhead product is obviously eliminated and a separate recovery of the solvent from the overhead product must occur. This can be performed of course by a simple distillation of the overhead product in such a way that the overhead product is withdrawn as a top product with a solvent content of $<10$ ppm from the distillation column, while the solvent concentrated to a purity of almost 100% is taken from the sump of this column and is fed back to the extractive distillation column. This operation, in which as complete as possible a separation of overhead product and solvent is desired, requires however a highly expensive apparatus(distillation column with a high plate number) and a high energy consumption.

In German Patent Application 34 09 030 a distillative separation of the solvent from the hydrocarbon of the overhead product which is only incompletely undertaken is described. This occurs by drawing a sump product from the overhead product distillation column, which still has a a portion of solvent therein. Subsequently this sump product is fed after a suitable cooling into a separating vessel, in which it separates into a light phase and a heavy phase. The heavy phase comprises a solvent and the hydrocarbons of the extract, which are present in the overhead product as impurities. Because of their composition they can be fed back into the extractive distillation column, while the light phase, which contains the usual components of the sump product, is fed back into the overhead product distillation column.

In performing the above-described process it has been shown in some cases that the effectiveness of the separating vessel is not satisfactory. This was the case particularly when the components of the heavy phase were put in the sump product drawn from the overhead product distillation column in the form of very fine drops, whose sedimentation speed was less than the rising speed of the components of the light phase. In this case the components of the heavy phase were fed back to an undesirable extent into the overhead product distillation column and thus the separation efficiency of this column was poor.

SUMMARY OF THE INVENTION

It is an object of the present invention to provide a method of working up an overhead product of an extractive distillation of a hydrocarbon mixture which avoids the above-described problems.

It is also an object of the present invention to provide a method of working up an overhead product of an extractive distillation of a hydrocarbon mixture, which is effective and economical and produces an overhead product which is not contaminated with solvent.

It is an additional object of the present invention to provide an apparatus for performing the method of working up the overhead product according to our invention.

In keeping with these objects and others which will become more readily apparent hereinafter, in a process of the above-described kind according to our invention the sump product from the overhead product distillation column is fed through a coalescer prior to feeding into the separating vessel.

In the coalescer the very fine drops of the heavy phase can combine into larger drops which then fall in the separating vessel without difficulty because of their higher sedimentation speed. A coalescer especially suited for performing the process of the invention is described below in more detail in connection with FIGS. 2 and 3. It has a plurality of wave-like or undulating plates positioned over each other so that the troughs of the wave plate cross section are parallel to the longitudinal direction of the coalescer and are inclined gently downwardly toward the entrance of the separating vessel.

In performing the process according to our invention it is especially suitable when the sump product is drawn from the overhead product distillation column with a solvent content of 20 to 75% by weight and is cooled to a temperature of 20° to 70° C. prior to introduction into the coalescer. The solvent content of the sump product of the overhead product distillation can be controlled by the sump temperature and the temperature of the heated column at the sump of the overhead product distillation column, since a certain relationship exists between the solvent content and the sump temperature so that the sump temperature climbs with increasing solvent content, whereby the sump temperature adjusts itself naturally depending on the boiling temperature of the solvent used and the composition of the hydrocarbon mixture worked up in the overhead product distillation column. Thus a solvent temperature of about 100° C. is reached for example in obtaining benzene from a raw benzene fraction in a gasoline cracking process by extractive distillation with N-formyl morpholine with a solvent content in the sump product of the overhead product distillation column of 50% by weight. In comparison the content of the same solvent in the sump product amounts to 75%, so the sump temperature amounts to about 125° C. Understandably instead of temperature measurement also other analytical methods, e.g. gas chromatography, can be used for measurement and control of the solvent content of the sum product.

Further individual features of the claimed process and of the apparatus used to perform it are set forth in the appended dependent claims and are illustrated in detail in the accompanying detailed description.

BRIEF DESCRIPTION OF THE DRAWING

An example of the method and apparatus of our invention will now be explained in more detail in the following detailed description, reference being made to the accompanying drawing, in which FIG. 2 is a schematic cross sectional view through one example of an apparatus with a coalescer and associated separating vessel according to our invention, FIG. 3 is a detailed cross sectional view of the coalescer through the plane A–B of FIG. 2, and FIG. 3A is detailed cross sectional view of a wave plate from the coalescer shown in FIG. 3.

DETAILED DESCRIPTION OF THE INVENTION

Figure 1:
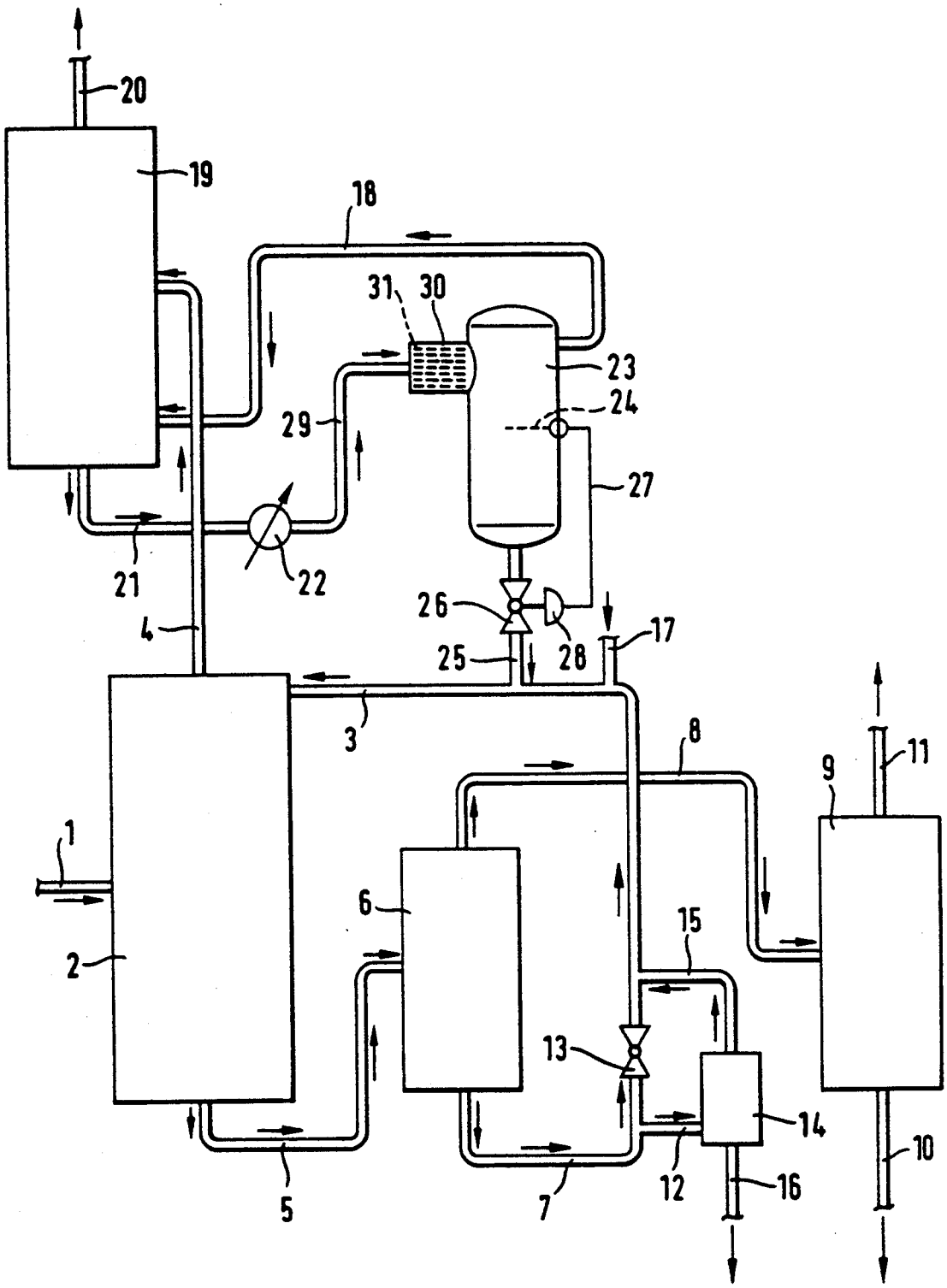
FIG. 1 is a flow chart illustrating one example of a process according to our invention.

The flow chart shown in FIG. 1 contains only the plant units required for performing the process, while auxiliary units, such as pumps, heated reaction vessels, heat exchangers, etc are not illustrated. The hydrocarbon mixture serving as a starting product, which if necessary can be subjected to a predistillation, is fed through the pipe 1 into the central portion of the extractive distillation column 2 provided with plates. The starting product is heated normally until slightly under the boiling point, so that it evaporates immediately on admission to the extractive distillation column. The selective solvent used is fed to the top of the extractive distillation column 2 through pipe 3 and flows over the plates of this column downwardly, so that it receives the vaporous hydrocarbon material. The lighter boiling hydrocarbon material, which forms the overhead product phase, escapes through the pipe 4 at the head of the column and arrives through this pipe in the central part of the overhead product distillation column 19 provided with filling bodies or plates.

The fluid sump product of the extractive distillation column 2 comprises the solvent and hydrocarbon material extract dissolved in it and is drawn over the pipe 5 from the extractive distillation column 2 and arrives in the decanter column 6, in which these hydrocarbon materials are distillatively separated from the selective solvent. The solvent is removed through the pipe 7 from the column sump and flows over the pipe 3 back again into the extractive distillation column 2, while the hydrocarbon material so obtained escapes through the top of the decanter column 6 and arrives through the pipe 8 in column 9, in which an additional separation occurs. Thus for example the higher-boiling components can be drawn off through the pipe 10 and the lower-boiling components can be drawn off through the pipe 11. When in the course of time impurities can concentrate in the solvent used, a branch pipe 12 is provided in the vicinity of the pipe 7, through which a portion of the solvent is flowed through the regeneration device 14 with the valve 13 set at an appropriate position. The regenerated solvent is fed back through the pipe 15 again into the circulation (pipe 7), while the collected impurities are removed from the regenerating device through the pipe 16. The pipe 17 subsequently acts to feed fresh solvent.

For performing the process according to our invention the sump product coming down the overhead product distillation column 19 with a solvent content of 20 to 75% by weight is drawn off through the pipe 21, while the hydrocarbon materials of the overhead product are removed from the overhead product distillation column 19 with a solvent content of under 10 ppm over the pipe 20. The drawn off sump product arrives in the cooler 22 over the pipe 21, in which it experiences the required cooling. After that the cooled material is conducted over the pipe 29 into the coalescer 30, which is constructed in one structural unit with the separating vessel 23. The sump product enters directly from the coalescer 30 directly in the upper portion of the separating vessel 23, in which the separating layer controller 24 is installed in the central portion. Since the sump product quantity flowing over the pipe 21 is comparatively small, in each case the cooler is not necessary for the required cooling. If necessary it is also possible to dispense with that cooler and the cooling of the sump product in the pipe 21 and instead to see that the separating vessel and the pipe are not insulated and/or that they are equipped with a cooling jacket. An excessive cooling of the sump product to a temperature under 20° C. is not desirable, since because of that the heat energy requirement in the overhead product distillation column 19 and the extractive distillation column 2 was increased unnecessarily. With a temperature between 20° and 70° C. the desired separation of the sump product fed in occurs in the upper and lower phase in the separating vessel. The differing compositions of these phases has already been pointed out above. The withdrawal of the heavy phase(lower phase) from the separating vessel 23 is controlled by the separating layer controller 24. This happens in such a way that the location of the separating layer between the heavy and the light phase influences the position of the separating layer controller 24, which is mounted freely movable on a pivot. As soon as the heavy phase in the lower portion of the separating vessel 23 has increased enough so that the separating layer between the heavier and the lighter phase is located at the same height as the separating layer controller 24, it takes the position shown approximately horizontal in the illustration(FIG. 1 and 2) and activates the positioning drive 28 of the valves 26 on reaching this position by the stepping line 27 in such a way that it is opened. Since the valve 26 is installed in the pipe 25, the heavier phase is drawn from the separating vessel 23 and can be combined by this pipe with the solvent flowing into the pipe 3. In contrast when the separating layer between the heavier phase and the lighter phase drops in the separating vessel 23, the position of the separating layer controller 24 changes downwardly and the valve 26 is closed and/or throttled because of that. The lighter phase(upper phase) is as a result removed over the pipe 18 from the separating vessel 23 and arrives in the sump of the overhead product distillation column 19. In varying the schema shown in the flow chart it is naturally also possible to not combine the heavy phase drawn through the pipe 25 with the solvent in the pipe 3, but to fed it separately into the upper portion of the extractive distillation column 2.

FIG. 2 shows the apparatus according to our invention, particularly the coalescer 30, which is combined with the separating vessel 23 in a single unit. One sees that the coalescer 30 is flanged onto the upper portion of the separating vessel 23, so that the sump product located in the coalescer 23 can flow directly from the overhead product distillation column into the upper portion of the separating vessel 23. The reference number 18, 25 and 29 show the connectors for the appropriate pipes and the reference number 24 the connector for the separating layer controller.

FIG. 3 shows finally a cross section through the coalescer 30 in the plane A–B of FIG. 2. One sees from the figure that the interior of the coalescer 30 is completely filled with wave plates 31 positioned over each other. These wave plates 31 are positioned in the coalescer 30 so that their troughs 32 are parallel to the longitudinal direction of the coalescer 30. Furthermore the wave plates 31 are inclined downwardly at about 1% in the direction of the entrance of the separating vessel 23 so that the sump product located in the coalescer 30 without more can flow into the separating vessel 23. The wave plates 31 advantageously can be blanched carbon steel, because this material guarantees a good wettability. The trough 32 of a wave plate 31 is shown again in detail. The depth a of the trough 21 in FIG. 3*a* should advantageously amount to about 20 mm.

In FIG. 2, as has already been mentioned, the coalescer 30 and the separating vessel 23 are constructed in a single unit, which certainly does show the embodiment described in this detailed description. When conditions require it, it is also possible to provide the coalescer 30 and the separating vessel 23 as separate units.

While the invention has been illustrated and described as embodied in an apparatus for or method of working up of an overhead product of an extractive distillation of a hydrocarbon mixture, it is not intended to be limited to the details, shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. A process for working up an overhead product of an extractive distillation of a hydrocarbon mixture performed in an extractive distillation column having a head, in which an N-substituted morpholine, whose substituents have no more than seven carbon atoms is used as a selective solvent, said process consisting essentially of the steps of withdrawing a lighter boiling component of said hydrocarbon mixture as said overhead product from said head of said extractive distillation column, distilling said overhead product in an overhead product distillation column subsequent to said withdrawing to recover a solvent residue in said overhead product, withdrawing a sump product of said overhead product distillation column with a portion of said solvent from said overhead product distillation column, separating said sump product into a lighter phase and a heavier phase in a separating vessel, and then feeding back said heavier phase into said extractive distillation column and said lighter phase into said overhead product distillation column, feeding said sump product from said overhead product distillation column through a coalescer prior to feeding into said separating vessel, cooling said sump product to a temperature of from 20° to 70° C. prior to feeding to said coalescer, the coalescer having a plurality of wave plates positioned over each other and distributed interiorly throughout said coalescer, said wave plates being provided with a plurality of troughs and being so positioned that said troughs are oriented parallel to a longitudinal direction of said coalescer and are inclined downwardly toward said separating vessel, said sump product being withdrawn from said overhead distillation column containing from 20 to 75% by weight of said solvent.

2. An apparatus for performing a process for working up an overhead product of an extractive distillation of a hydrocarbon mixture performed in an extractive distillation column having a head, in which an N-substituted morpholine whose substituents have no more than seven carbon atoms is used as a selective solvent, said apparatus consisting essentially of means for withdrawing a lighter boiling component of said hydrocarbon mixture as an overhead product from said head of said extractive distillation column, means for distilling said overhead product subsequent to said withdrawing to recover a solvent residue in said overhead product, means for withdrawing a sump product of said means for distilling with a portion of said solvent from said means for distilling, means for separating said sump product into a lighter phase and a heavier phase in a separating vessel and means for feeding back said heavier phase into said extractive distillation column and said lighter phase into said means for distilling, a coalescer connected to said separating vessel so as to receive said sump product and so that said sump product passes through said coalescer to said separating vessel, said coalescer having a plurality of wave plates positioned over each other and distributed interiorly throughout said coalescer, said wave plates being provided with a plurality of troughs and being so positioned that said troughs are oriented parallel to a longitudinal direction of said coalescer and are inclined downwardly toward said separating vessel, said sump product passing through said coalescer in said troughs to said separating vessel, and means for cooling said sump product to temperature of from 20° to 70° C. prior to feeding to said coalescer.

3. The apparatus according to claim 2, wherein said coalescer is flanged to an upper portion of said separating vessel to form a single unit, said single unit comprising said separating vessel and said coalescer.

4. The improvement according to claim 2, wherein said wave plates are made of blanched carbon steel.

* * * * *